United States Patent [19]

Prew

[11] Patent Number: 4,596,064

[45] Date of Patent: Jun. 24, 1986

[54] METHOD FOR MANUFACTURING A SCREW FLIGHT

[75] Inventor: Stanley R. Prew, Montoursville, Pa.

[73] Assignee: Koppers Company, Inc., Pittsburgh, Pa.

[21] Appl. No.: 631,855

[22] Filed: Jul. 18, 1984

[51] Int. Cl.[4] ..... B23P 15/04; B21D 53/78

[52] U.S. Cl. ..... 29/156.8 B; 29/156.8 R; 72/299; 72/371; 72/379

[58] Field of Search ..... 72/299, 298, 371, 379, 72/387, 135, 125, 115; 29/23.5, 156.8 R, 156.8 B, 157.3 AH, 173, 433; 198/676, 677; 228/173.6

[56] References Cited

U.S. PATENT DOCUMENTS

| | | | |
|---|---|---|---|
| 649,700 | 5/1900 | Lorenz | 29/156.8 R |
| 651,748 | 6/1900 | Dierdorff | 29/156.8 R |
| 2,760,255 | 8/1956 | Compton | 29/157.3 AH |
| 3,485,116 | 12/1969 | Fender | 76/2 |
| 3,505,852 | 4/1970 | Sassak | 72/321 |
| 3,566,501 | 3/1971 | Winchester | 29/157.3 |
| 3,580,039 | 5/1971 | Heinonen | 72/371 |
| 3,667,276 | 6/1972 | Moodey | 72/371 |
| 3,708,060 | 1/1973 | Ben-Natan | 72/379 |

FOREIGN PATENT DOCUMENTS

| | | | |
|---|---|---|---|
| 1457447 | 11/1966 | France | 72/135 |
| 100829 | 8/1980 | Japan | 72/379 |

OTHER PUBLICATIONS

E. J. Stefanides "Conveyor Flights are Twisted to Helical Shape" *Design News,* Dec. 5, 1983, pp. 101–103.

*Primary Examiner*—Daniel C. Crane

*Attorney, Agent, or Firm*—Daniel J. Long; Herbert J. Zeh, Jr.

[57] ABSTRACT

A method and apparatus for manufacturing the screw flight section of a screw conveyor is disclosed. The apparatus includes two horizontal arms which extend from a vertical support and at the terminal end of these arms there are dies for engaging the inner and outer peripheral edges of a flat, sheet metal, annulus-shaped blank with a radial slit. One die is turned on its longitudinal axis while the other remains stationary so that the blank is twisted. After the blank is circumferentially displaced relative to the dies, it is again twisted in the above described manner. This procedure is repeated around the entire circumference of the blank with the result that a helical form is applied to the blank.

10 Claims, 3 Drawing Figures

METHOD FOR MANUFACTURING A SCREW FLIGHT

BACKGROUND OF THE INVENTION

1. Field of the Invention

The present invention relates to screw conveyors and, in particular, to methods and apparatus for manufacturing the screw flight sections of screw conveyors.

2. Description of the Prior Art

The screw flight section of a screw conveyor is a helical ribbon that is attached to a shaft so that material will be conveyed along the length of the shaft when the assembly is rotated about its longitudinal axis.

In the prior art screw flights have usually been fabricated by one of three methods. None of these previous methods has been wholly satisfactory.

One method, a hot-rolling method, produces continuous flights by treating flat bar stock in a rolling machine. Its use, however, has been limited because it has the disadvantage of causing thinning of the more wear-prone outer portion of the flight.

A second method, a stretch method, produces the flights as a weldment of partially formed sections made from blanks of split-ring configuration. After welding, the assembled flight is stretched to the required length. This method eliminates the thinning problem, but has the disadvantage of producing variations in pitch of the flight's screw form. This pitch variation reflects difference in helix angles that result from large variations in the thickness of the blank material.

The third method, the stamping method, attempts to minimize pitch variations by forming these split-ring blanks between dies. This method provides better control of helix angles and has been the most popular means of producing the flights. One disadvantage of this method is its high tooling costs. A separate set of dies is required for each combination of diameter, pitch, and thickness and grade of material used. A second disadvantage is the need for frequent and skillful adjustment of dies and press equipment to compensate for the unavoidable differences in material thickness and spring-back properties.

SUMMARY OF THE INVENTION

The object of the present invention is to provide a method and apparatus for manufacturing a screw flight which avoids the above mentioned disadvantages. The apparatus includes two spaced horizontal arms which both extend from a common vertical support. At the terminal end of each of these arms there is a die. These dies have opposed vertical grooves so that when a flat, annulus-shaped blank having a radial slit is retained at its inner peripheral side by the lower die, the outer peripheral edge will be retained by the upper die.

After the blank has been inserted in the dies in the way described above, the upper die will be turned on its longitudinal axis while the lower die remains stationary so as to effect a twisting of the blank. Thereafter, the blank is turned on its central axis so that new portions of the inner and outer edges of the blank are retained in the die. The upper die is again turned while the lower die remains stationary so that the blank is again twisted. The procedure is then repeated until the entire periphery of the blank has been treated in this manner and a helical shape has been applied to the blank.

BRIEF DESCRIPTION OF THE DRAWINGS

The present invention is further described with reference to the attached drawings in which.

DETAILED DESCRIPTION

Figure 1:
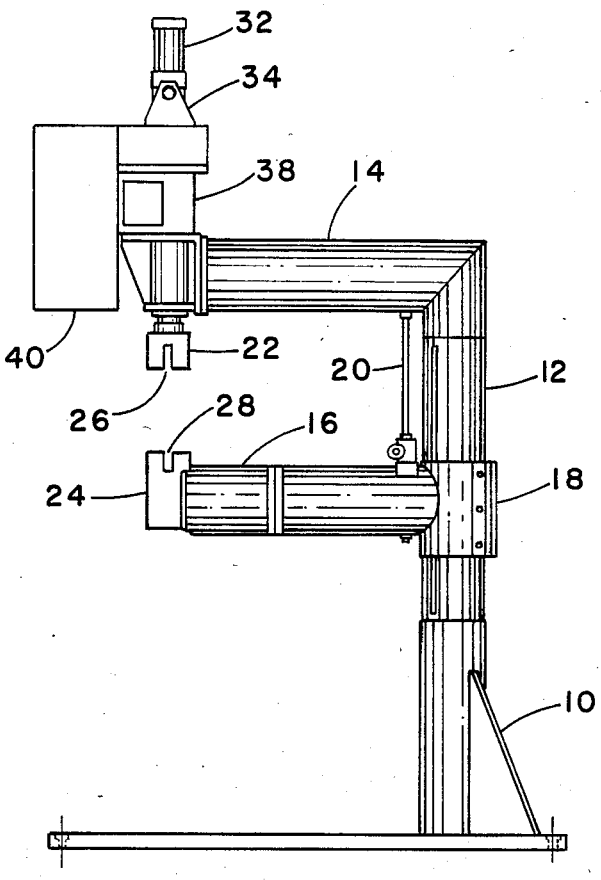
FIG. 1 is a side elevational view of a preferred embodiment of the present invention.
Figure 2:
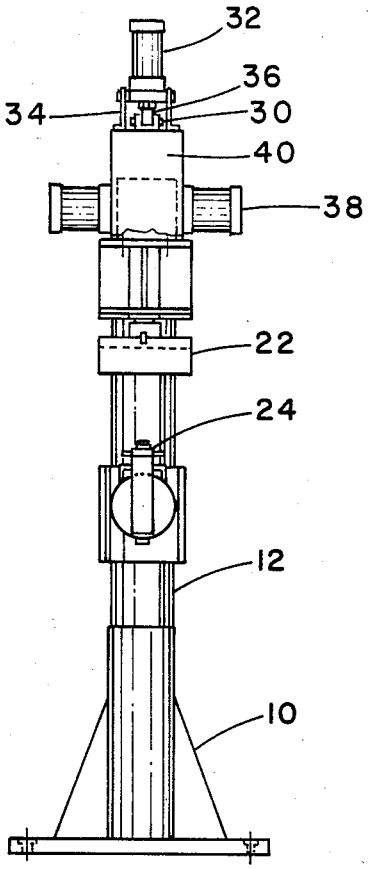
FIG. 2 is an end view of the apparatus shown in FIG. 1.

Referring to FIGS. 1 and 2, it will be seen that the apparatus of the present invention includes a base 10 from which there projects a vertical support 12. Extending laterally from this vertical support is a fixed horizontal arm 14. Below this fixed horizontal arm is a moveable lower horizontal arm 16 which is slideably attached to the vertical support 12 by means of sleeve 18. The vertical position of this lower horizontal arm can be adjusted by means of screw jack 20.

At the terminal end of the upper arm 14 there is a rotatable upper die 22. At the terminal end of the lower arm 16 there is a stationary lower die 24. There is a transverse groove 26 across the lower end of the upper die 22, and a transverse groove 28 across the upper end of the lower die 24. Said grooves are parallel and vertically aligned.

The upper die 22 is positioned on the lower terminal end of a vertical sliding shaft 30. At the upper end of the sliding shaft there is a pneumatic cylinder 32 which is fixed to cylinder support 34. Rod 36 extends downwardly from the cylinder and is fixed to the upper end of the sliding shaft so that the sliding shaft and the upper die can be displaced in the vertical direction by expansion and contraction of the pneumatic cylinder. The sliding shaft and the upper die can also be turned on their longitudinal axes by means of a hydraulic rotary actuator 38. For the purpose of this disclosure, the "longitudinal axis" of the upper die will be considered to be its axis which is perpendicular to its lower end and its transverse groove 26. A suitable rotary actuator is available, for example, from the Parker Hannifin Corp. Controls for the pneumatic cylinder and the hydraulic rotary actuator are located on a control panel 40.

Figure 3:
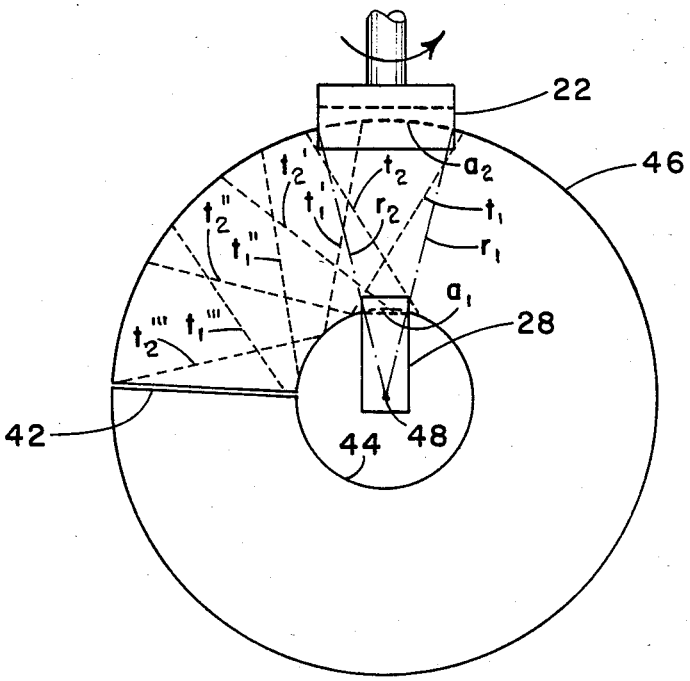
FIG. 3 is a schematic view of an annulus-shaped blank on which the apparatus shown in FIGS. 1 and 2 may be used to practice the method of the present invention.

In order to use the above described apparatus to practice the method of the present invention, a flat, sheet metal annulus-shaped blank such as is shown in FIG. 3 is first prepared. It will be noted that there is a radial slit 42 on this blank. For definitional purposes, it will also be noted that this blank has an inner peripheral edge 44, an outer peripheral edge 46 and a center point 48.

After the above described blank has been formed, it is emplaced between the upper and lower dies. The inner peripheral edge of the blank is first emplaced in the groove of the lower die. If necessary, the height of the lower arm may first be adjusted to accommodate the particular size of the blank used. Thereafter, the pneumatic cylinder is actuated to move the upper die downwardly to engage the outer peripheral edge of the blank with the transverse groove of the upper die. Preferably, the blank is initially engaged by the dies adjacent its radial slit.

From FIG. 3 it will also be noted that an approximate relationship exists between the size of the arcs retained by the lower die on the inner peripheral edge of the blank and by the upper die on the outer peripheral edge. That is, two radial lines $r_1$ and $r_2$ extend radially from the center point of the blank forming between them an angle A. Interposed between these radial lines are arcs $a_1$ and $a_2$ on, respectively, the inner peripheral edge and the outer peripheral edge of the blank. The lower die will retain an amount of the inner peripheral edge of the blank, approximately equal to arc $a_1$ while the upper die retains an amount of the outer peripheral edge approximately equal to arc $a_2$. Angle A will preferably be from about 15 degrees to about 20 degrees.

After the blank has been engaged by the upper and lower dies in the manner described above, the upper die is turned on its longitudinal axis while the lower die remains stationary so as to effect a twisting of the blank. The upper die will preferably be turned by an angular amount which is approximately equal to the differential helix angle, i.e., the difference between the helix angle at the inner diameter and the helix angle at the outer diameter, which is desired on the completed screw flight. Referring again to FIG. 3, it will be seen that the twisting of the blank will occur, for the situation illustrated, generally along twist lines $t_1$ and $t_2$.

After such twising has occurred, the upper die is vertically displaced to move it out of engagement with the outer peripheral edge of the blank. The blank is then circumferentially displaced, i.e., rotated about its central axis, by an amount equal to approximately one-half of angle A, although, depending on factors such as the thickness of the blank, a somewhat smaller or larger displacement such as an amount approximately equal to angle A may be preferable in particular situations. After this angular displacement of the blank has been effected, the upper die is moved downwardly to again engage the outer peripheral edge of the blank. Thereafter, the upper die is again turned in the same direction and by approximately the same amount as it was previously turned so as to again twist the blank. The upper die is then disengaged from the blank and the blank is again circumferentially displaced. After the blank is again engaged by the upper die, it is again turned to effect a twisting of the die similar to that achieved in the previous step. Referring, for example, to FIG. 3, twist lines corresponding, respectively, to lines $t_1$ and $t_2$ and resulting from previous twisting operations on the blank are shown respectively at lines $t_1'$, $t_1''$, and $t_1'''$ and at $t_2'$, $t_2''$ and $t_2'''$.

The above procedure is repeated until the entire circumference of the blank has been subject to the above described twisting procedure so that when these successive operations are complete the blank will be formed into a substantially helical shape. Preferably, the blank will be circumferentially displaced and the upper die will be turned by substantially constant angular amounts during each such procedure. Two or more helical shapes formed in this manner may be welded together end to end to form a screw flight of extended length.

It will be appreciated that there has been described a method and apparatus for efficiently manufacturing a screw flight. Although the invention has been described with a certain degree of particularity, it is to be understood that the present disclosure has been made only as an example and that the scope of the invention is defined by what is hereafter claimed.

What is claimed is:

1. A method for manufacturing a screw flight comprising:

(a) preparing a flat, sheet metal, annulus-shaped blank having opposed lateral sides and an inner peripheral edge and an outer peripheral edge, there being a radial slit extending between said inner and outer peripheral edges and there also being an inner arc on said inner peripheral edge and an outer arc on said outer peripheral edge, said inner and outer arcs being interposed between two lines radially diverging from the center point of the annulus-shaped blank;

(b) then engaging the blank on its inner peripheral edge with a first die such that said first die substantially covers the inner arc and engaging the blank on its outer peripheral edge with a second die such that said second die substantially covers the outer arc and then turning one of said dies on its longitudinal axis while said other die remains stationary so as to twist the blank;

(c) then circumferentially displacing the blank relative to said first and second dies and then engaging the blank on its inner peripheral edge with the first die such that said first die substantially covers an arc at least partially circumferentially displaced from the arc covered in the previous step and engaging the blank on its outer peripheral edge with the second die such that said second die substantially covers an arc at least partially circumferentially displaced from the arc covered in the previous step and then turning the die turned in the previous step in the same direction said die was turned in said previous step while said other die remains stationary so as to twist the blank; and (d) then, while maintaining a constant direction of circumferential displacement of the blank, repeatedly effecting the procedure recited in the previous step, until the blank is twisted along its entire inner and outer peripheries such that it is formed into a substantially helical shape.

2. The method recited in claim 1 wherein the inner and outer arcs are approximately adjacent the radial slit.

3. The method recited in claim 1 wherein the two lines radially diverging from the center point of the annulus-shaped blank are separated by an angle of from about 15 degrees to about 20 degrees.

4. The method recited in claim 1 wherein the die turned on its longitudinal axis in step (b) is turned by an angular amount approximately equal to the desired differential helix angle of the completed screw flight.

5. The method recited in claim 1 wherein in step (b) the first die remains stationary and the second die is turned on its longitudinal axis.

6. The method recited in claim 1 wherein the blank is circumferentially displaced in step (b) by an angular amount approximately equal to one-half the angle between the two lines diverging from the center point of the annulus-shaped blank.

7. The method recited in claim 1 wherein the blank is circumferentially displaced in step (c) by an angular amount approximately equal to the angle between the two lines diverging from the center point of the annulus-shaped blank.

8. The method recited in claim 1 wherein after the blank is formed into a substantially helical shape, the method recited in said claim is repeated to form a substantially helical shape from at least one other flat, sheet metal, annulus-shaped blank, after which said two or more helical shapes are fixed together end to end to form a screw flight of extended length.

9. The method recited in claim 1 wherein the angular amount of circumferential displacement of the blank remains substantially constant in successive steps.

10. The method recited in claim 9 wherein the die which is turned is turned by a substantially constant angular amount in successive steps.

* * * * *